US008814020B2

(12) United States Patent
Yaeger et al.

(10) Patent No.: US 8,814,020 B2
(45) Date of Patent: Aug. 26, 2014

(54) SYSTEM FOR QUICK RELEASE OF PACK

(75) Inventors: Larry Yaeger, Maple Grove, MN (US); Shannon Reents, Coon Rapids, MN (US); Richard Hopperstad, Columbia Heights, MN (US)

(73) Assignee: Honeywell International Inc., Morristown, NJ (US)

( * ) Notice: Subject to any disclaimer, the term of this patent is extended or adjusted under 35 U.S.C. 154(b) by 487 days.

(21) Appl. No.: 13/164,335

(22) Filed: Jun. 20, 2011

(65) Prior Publication Data

US 2012/0318837 A1 Dec. 20, 2012

(51) Int. Cl.

| | |
|---|---|
| ***A45C 1/04*** | (2006.01) |
| ***A45F 3/00*** | (2006.01) |
| ***A45F 3/08*** | (2006.01) |
| ***A45F 3/14*** | (2006.01) |
| ***A45F 3/06*** | (2006.01) |

(52) U.S. Cl.

CPC ... *A45F 3/14* (2013.01); *A45F 3/08* (2013.01); *A45F 2003/003* (2013.01); *A45F 3/06* (2013.01)

USPC ..... 224/665; 224/627

(58) Field of Classification Search

USPC ..... 224/665, 578, 579, 580, 671, 672, 673, 224/674, 675; 24/3.7; 2/2.5, 102

See application file for complete search history.

(56) References Cited

U.S. PATENT DOCUMENTS

| | | | | |
|---|---|---|---|---|
| 842,498 | A | 1/1907 | Schmidt | |
| 2,807,035 | A | 9/1957 | Phillips | |
| 4,455,718 | A | 6/1984 | Finnern | |
| 4,858,797 | A * | 8/1989 | Rabska | 224/162 |
| 5,311,833 | A * | 5/1994 | VanTassel et al. | 114/315 |
| 5,341,973 | A * | 8/1994 | Dawes et al. | 224/196 |
| 5,632,071 | A * | 5/1997 | Maunder | 24/580.1 |
| 5,724,707 | A * | 3/1998 | Kirk et al. | 24/3.7 |
| 5,823,414 | A * | 10/1998 | Gal et al. | 224/637 |
| 7,047,570 | B2 * | 5/2006 | Johnson | 2/102 |
| 7,080,430 | B2 * | 7/2006 | Wemmer | 24/578.13 |
| 7,240,404 | B2 * | 7/2007 | Flossner | 24/3.7 |
| 7,490,358 | B1 * | 2/2009 | Beck | 2/2.5 |
| 7,526,842 | B2 * | 5/2009 | Wemmer | 24/578.13 |
| 7,694,862 | B2 * | 4/2010 | Bergeron | 224/665 |
| 7,909,214 | B2 * | 3/2011 | Gold et al. | 224/625 |
| 7,963,427 | B2 * | 6/2011 | Calkin | 224/675 |
| 8,002,159 | B2 * | 8/2011 | Cragg | 224/579 |
| 8,079,503 | B1 * | 12/2011 | Yeates et al. | 224/666 |
| 8,453,899 | B1 * | 6/2013 | Calkin | 224/675 |

(Continued)

FOREIGN PATENT DOCUMENTS

| | | | | |
|---|---|---|---|---|
| JP | 2003310351 A * | 11/2003 | | A45F 3/08 |
| WO | WO2009005782 A1 * | 8/2009 | | A45F 3/04 |

*Primary Examiner* — Justin Larson
*Assistant Examiner* — Lester L Vanterpool
(74) *Attorney, Agent, or Firm* — Fogg & Powers LLC

(57) ABSTRACT

One exemplary embodiment is directed toward an apparatus for quick release of a pack from a vest of a user. The apparatus includes a pack having one or more first loops, and a retaining member configured to extend through the one or more first loops and one or more second loops on the vest, wherein the retaining member is configured to releasably attach the pack to the vest by mechanically coupling the one or more first loops and the one or more second loops to the retaining member, wherein the retaining member is configured to enable detaching of the pack from the vest by pulling of the retaining member from the one or more first loops and the one or more second loops.

19 Claims, 6 Drawing Sheets

(56) References Cited

U.S. PATENT DOCUMENTS

2005/0015943 A1* 1/2005 Wemmer ..... 24/580.1
2007/0289045 A1* 12/2007 Evans et al. ..... 2/102
2009/0173763 A1* 7/2009 Bridgeman ..... 224/674
2009/0282595 A1* 11/2009 Branson et al. ..... 2/2.5
2010/0071106 A1 3/2010 Parks
2010/0281606 A1 11/2010 Kordecki
2011/0191933 A1* 8/2011 Gregory et al. ..... 2/69
2011/0278339 A1* 11/2011 Hexels ..... 224/676

* cited by examiner

SYSTEM FOR QUICK RELEASE OF PACK

BACKGROUND

Military, police, and other personnel often wear a vest for protection and for carrying of items while performing their particular role. These vests can be referred to as flack jackets, MOLLE vests, tactical vests, and others. These vests often have attachment points and pockets to hold a wide variety of items, and to hold many items simultaneously. Typically, the personnel (e.g., users) are often required to wear the vests and carry these items for long periods of time. The weight of the vest with all the items attached can be significant. In addition to the weight of the vest material and items, many of these vests include armor. This weight and/or the size of the vest and associated items can be detrimental when the user attempts to move quickly or over a long distance. Accordingly, many vests are equipped with quick removal features that enable the user to quickly remove the vest and its associated items from his or her person. With the vest removed, the user can move about without the extra weight and/or size of the vest and associated items. Once the user has dropped his vest, however, he no longer has access to any of the items attached to the vest. Additionally, as mentioned above, many vests include armor; thus, when a user drops his vest, the user also drops his protective armor.

SUMMARY

One exemplary embodiment is directed toward an apparatus for quick release of a pack from a vest of a user. The apparatus includes a pack having one or more first loops, and a retaining member configured to extend through the one or more first loops and one or more second loops on the vest, wherein the retaining member is configured to releasably attach the pack to the vest by mechanically coupling the one or more first loops and the one or more second loops to the retaining member, wherein the retaining member is configured to enable detaching of the pack from the vest by pulling of the retaining member from the one or more first loops and the one or more second loops.

DRAWINGS

Understanding that the drawings depict only exemplary embodiments and are not therefore to be considered limiting in scope, the exemplary embodiments will be described with additional specificity and detail through the use of the accompanying drawings, in which.

Figure 4B:
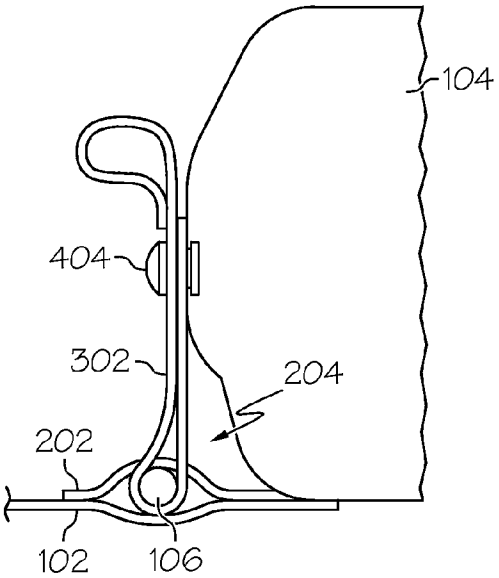
Figure 4C:
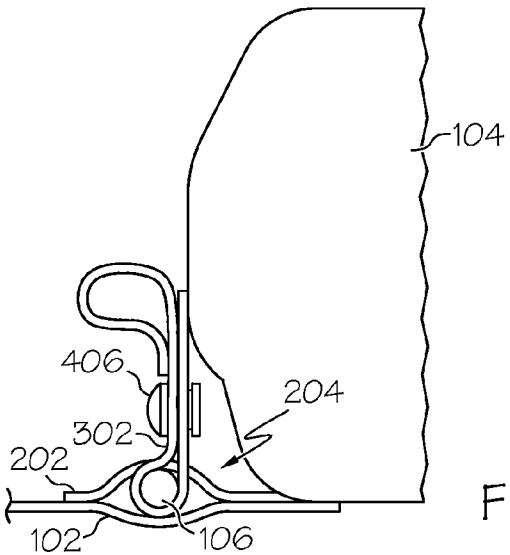
Figure 4A:
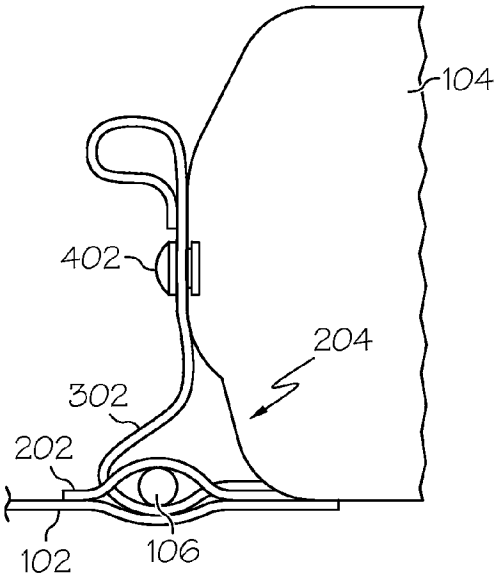

FIGS. 4A, 4B, and 4C are means for attaching the pack to the vest according to some embodiments.

Figure 5:
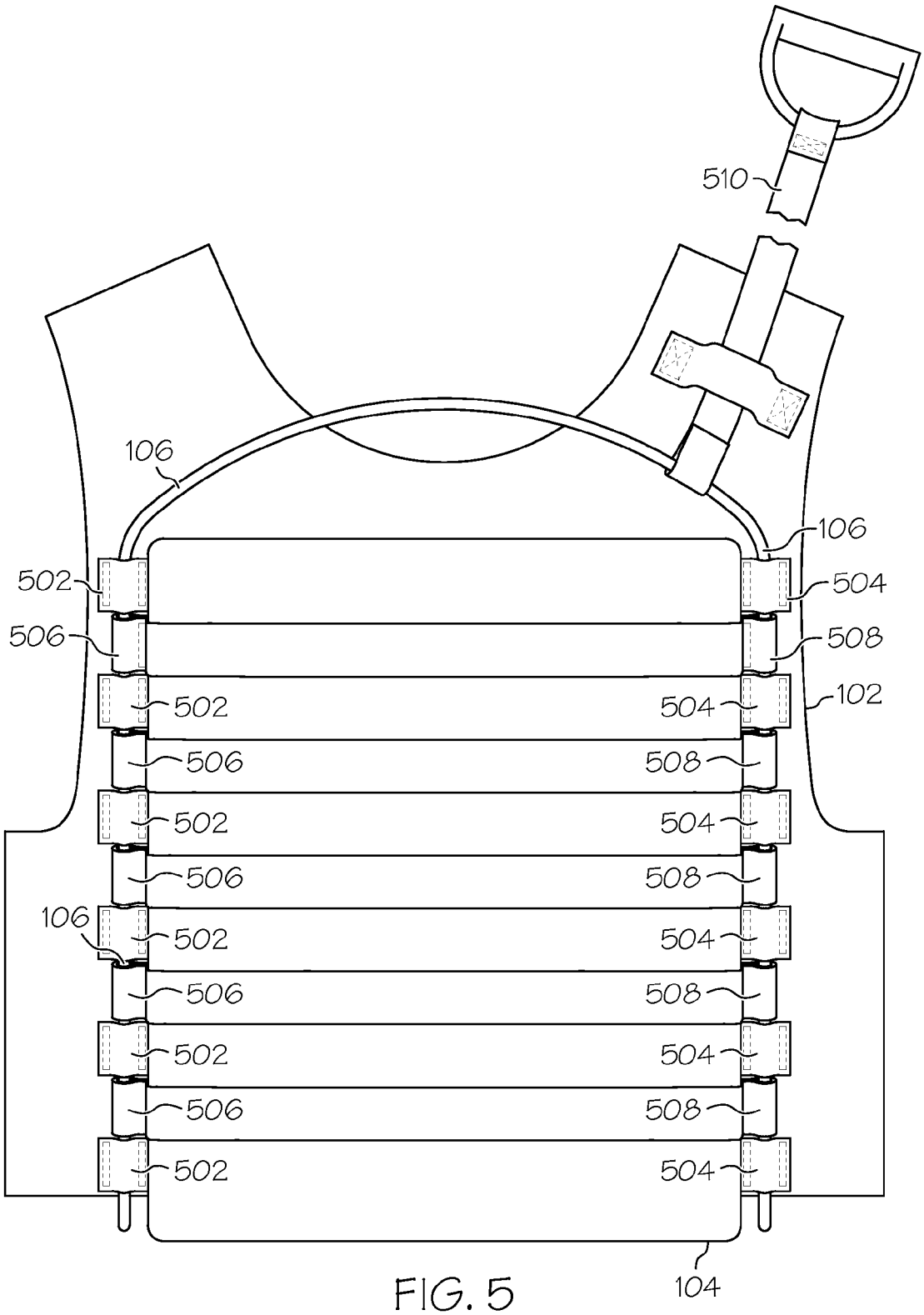

FIG. 5 is a perspective view of a system for quick release of a pack from a vest according to some embodiments.

Figure 6:
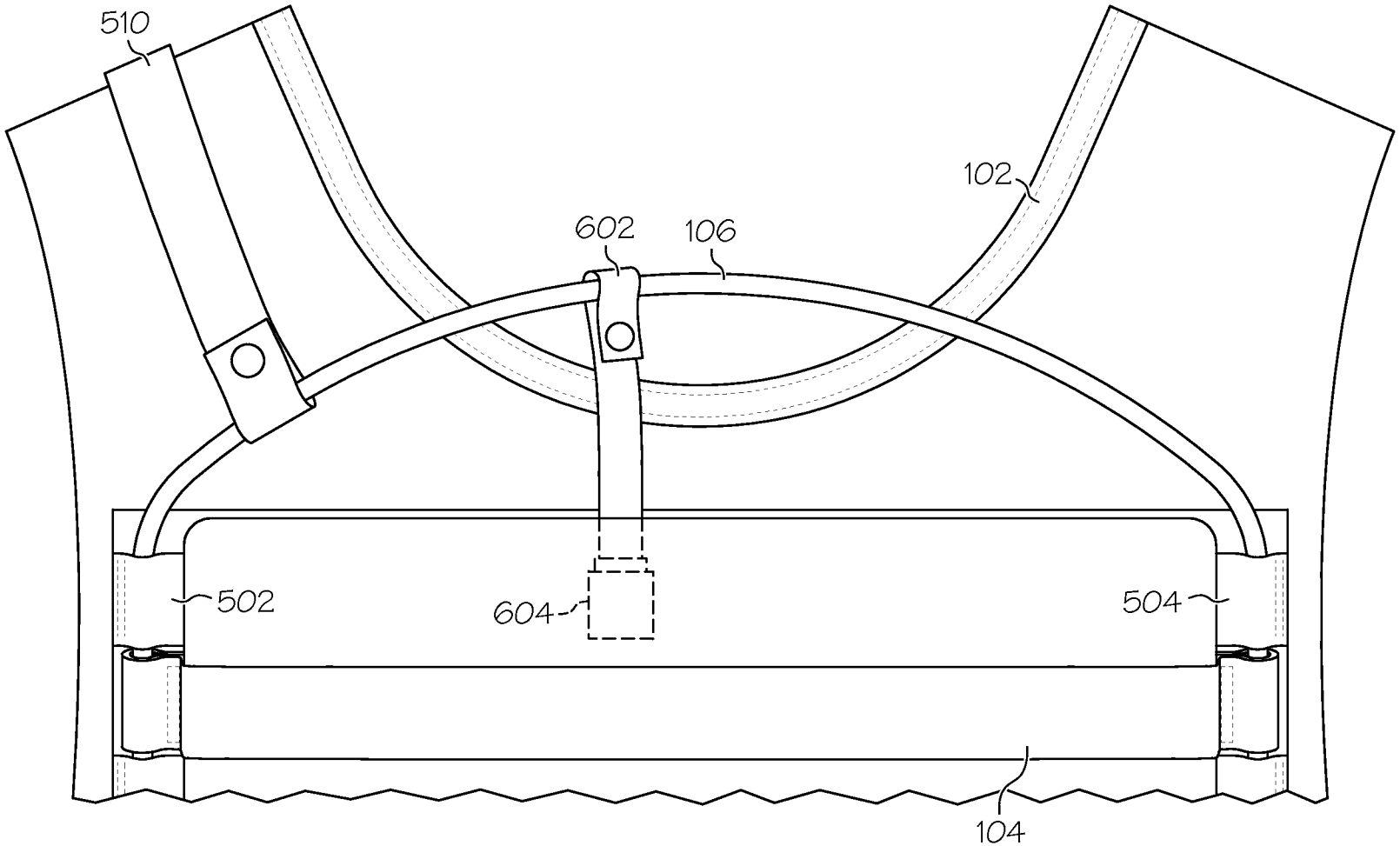

FIG. 6 is a close-up view perspective view of a retaining member, a lanyard, and a pull strap for quick release of a pack from a vest according to some embodiments.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

To address the concerns raised by removal of the vest from a user, embodiments described below provide for a system for quick release of a pack from a vest while allowing the vest to remain on the person. The embodiments describe below also provide for secure attachment of the pack to the vest prior to release. Additionally, the embodiments described below provide for automatic deactivation (e.g., zeroization) of electronics associated with the pack when the quick release mechanism is engaged.

Figure 1:
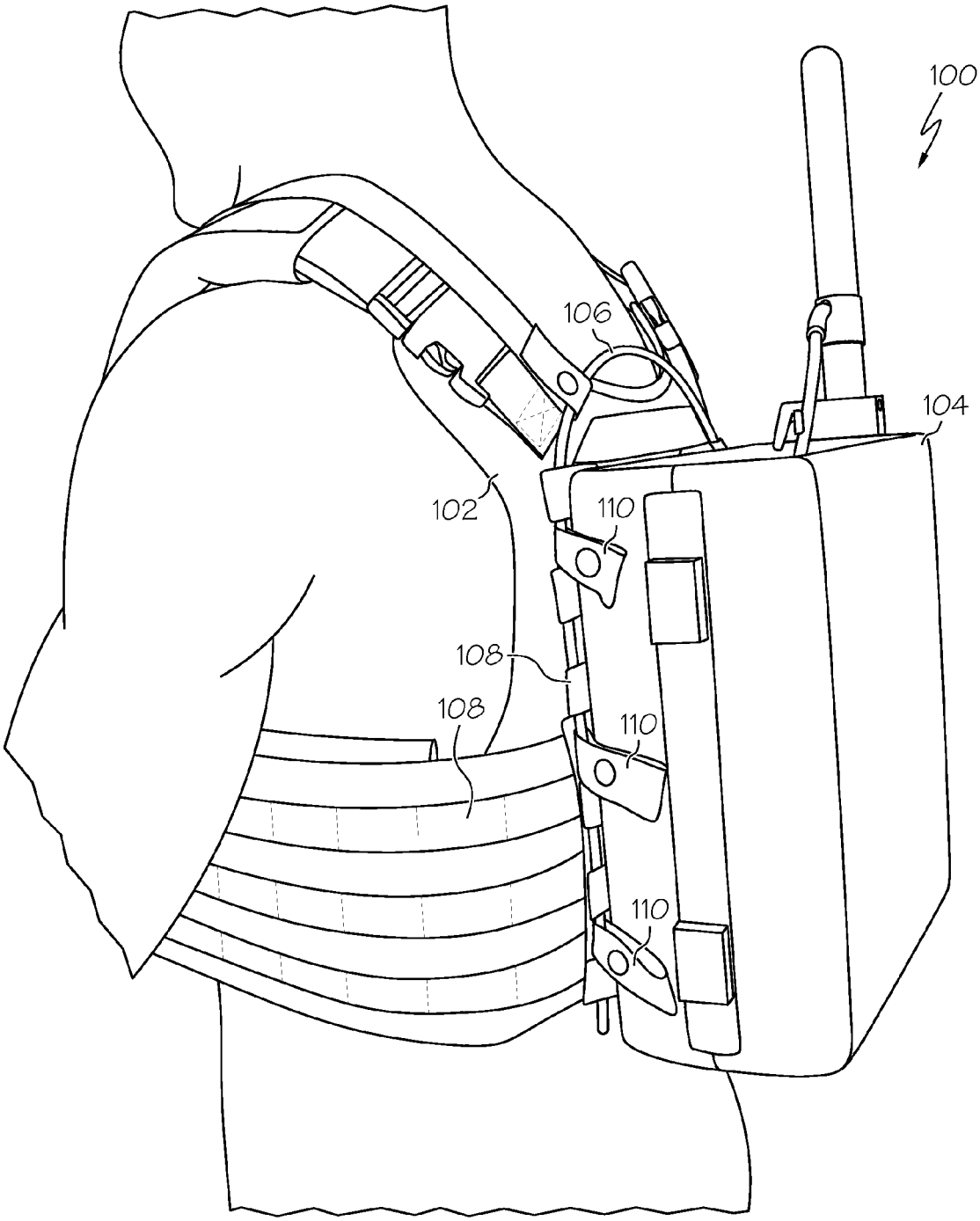
FIG. 1 is a perspective view of a system for quick release of a pack from a vest according to some embodiments.

FIG. 1 is a perspective view of a system 100 for quick release of a pack from a vest according to some embodiments. The system 100 can include a vest 102, a pack 104, and a retaining member 106. The vest 102 can include any type of vest or garment worn about a person. In an example, the vest 102 comprises a MOLLE vest that is worn about the upper body of a person.

The vest 102 can include one or more loops 108 to which items can be clipped, inserted, or otherwise attached. In an example, a loop 108 can be formed by an aperture between a surface of the vest 102 and a strap that is attached (e.g., sewn) to the vest in two spaced apart sections. The loop, therefore, is formed of an aperture between two stitches and between the strap and the surface of the vest 102. As shown, multiple loops 108 can be formed from a single strap by sewing the strap to the vest 102 in more than two locations. This, however, is merely an example and many other means of forming a loop can be used. For example, a loop 108 can be formed entirely from a strap that doubles back on itself and is attached (e.g., sewn) to the vest 102. A loop 108 can also be formed of a grommet, a hole in the fabric of the vest 102, and other means.

In an example, the pack 104 can be a rigid or flexible container configured to hold one or more items. The pack 104 can include one or more loops 110 for releasably attaching the pack 104 to the vest 106. In an example, the one or more loops 110 can be formed of a strap that is attached to the pack 106 and doubles back on itself to form the loop. In an example, the one or more loops 110 can be openable such that the loop can be opened to enable easy attachment of the pack 104 to the vest 102. For example, one end of the strap can be permanently attached to the pack 104 and the other end of the strap can be removably attached to the pack 104 or back to the strap itself. This removable attachment can be accomplished with a suitable fastening member such as a snap, buckle, hook-and-loop connector, pin, button, or other means. This, however, is merely an example, and many other means for forming a loop can used including a loop formed between a strap and a surface of the pack 104, a grommet, a hole, or other means.

Figure 2:
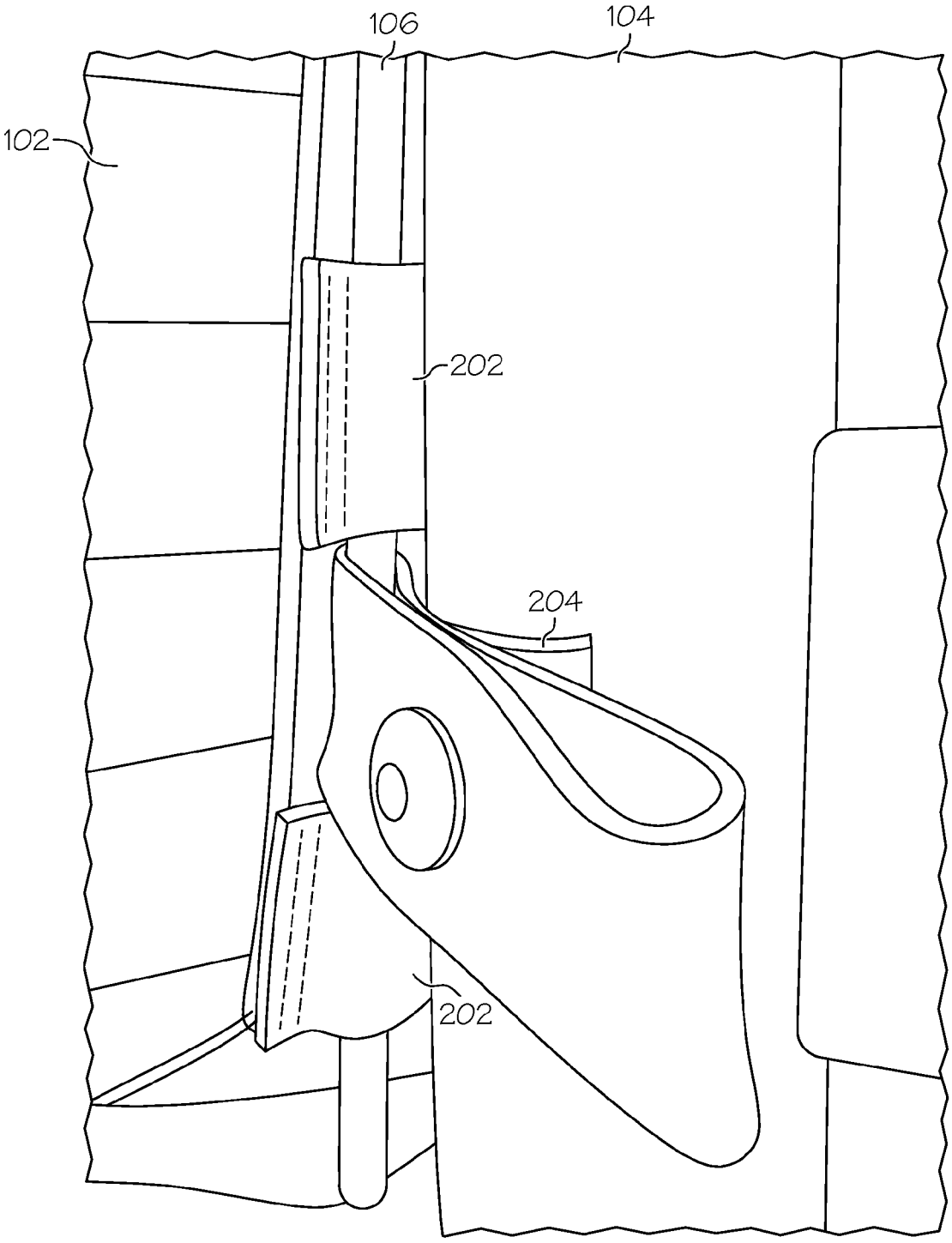
FIG. 2 is a close-up perspective view of the pack and vest from FIG. 1 according to some embodiments.

FIG. 2 is a close-up perspective view of two loops 202 of the one or more loops 108 on the vest 102 as well as one loop 204 of the one or more loops on the pack 104. The retaining member 106 is also shown. The loop 204 on the pack 102 is shown in the closed position with the retaining member 106 extending through the loop 204. The retaining member 106 also extends through the loops 202 on the vest 102.

By extending through the loops 202, the retaining member 106 is mechanically coupled to the vest 102. The mechanical coupling of the loops 202 restricts movement of the retaining member 106 in a radial direction with respect to the loops 202. Similarly, the retaining member 106 is mechanically coupled to the pack 104 by extending through the loop 204 which restricts movement of the retaining member 106 in a radial direction with respect to the loop 204. The retaining member 106 also has a certain amount of resistance to deflection. This resistance to deflection along with the mechanical coupling of the retaining member 106 to the vest 102 and the pack 104 acts to releasably and securely attach the pack 104 to the vest 102. For example, if the loops 202, 204 are disposed such that the radial restriction on movement of the retaining member 106 by the loops 202 is aligned with the radial restriction on movement of the retaining member 106 by the loops 204, and the retaining member 106 is disposed such that a resistance to bending is aligned with the radial restrictions from the loops 202, 204, then the pack 104 should also be restricted from movement in this direction with respect to the vest 102.

Moreover, by having at least one loop 204 on the pack 104 mechanically coupled to the retaining member 106 between two loops 202 on the vest 102 that are mechanically coupled to the retaining member 106, the pack 104 is also restricted from movement in an axial direction with respect to the loops 202. This restriction in axial movement is due to the loop 204 coming into contact with the loops 202 when the loop 204 moves in an axial direction. The pack 104, therefore, is attached to the vest 102 due to the mechanical restriction in movement of the pack 104 with respect to the vest 102. In particular, the combination of the restriction in radial and axial movement can combine to restrict movement in most or all directions when the retaining member 106 is inserted.

Figure 3:
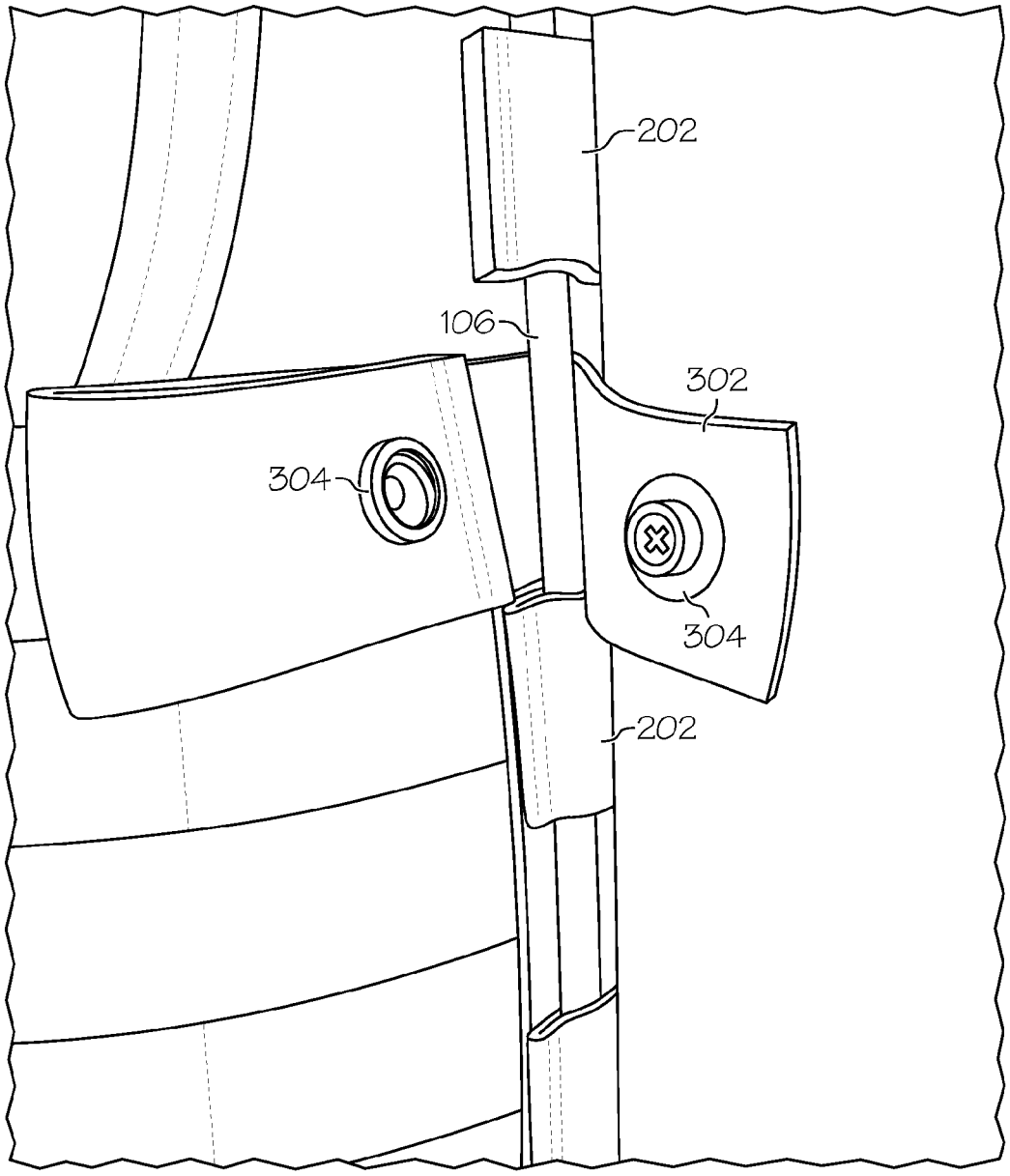
FIG. 3 is another close-up perspective view of the pack and vest from FIG. 1 showing a method for attaching the pack to the vest according to some embodiments.

FIG. 3 is another close up view of loops 202 on the vest 102 and an open strap 302 on the pack 104. The strap 302 can be closed to form the loop 204 by attaching both ends of the strap 302 together with the fastening member 304. In this example, the fastening member 304 is a snap; however, other fastening members 304 can be used. Opening the strap 302 enables the pack 104 to be easily attached to the vest 102. For example, with the retaining member 106 inserted through the loops 204 of the vest 102, the strap 302 can be opened as shown in FIG. 3 and woven around the retaining member 106 between two of the loops 202. Then, the fastening member 304 can be used to attach the strap 302 to itself to form the loop 204. Again, this is merely an example and other means can be used to attach the pack to the vest 102 and/or retaining member 104. Additionally, other means can be used to form the loop 204 attaching the strap 302 to the pack 104 instead of back to itself.

FIGS. 4A, 4B, 4C are bottom views of the pack 104 and the vest 102 showing alternative means of forming the loops 204 on the pack 104. In FIG. 4A, one end of the strap 302 is attached to a side of the pack 104 using a fastening member 402 such as a rivet. Another end of the strap 302 is attached to a back of the pack 104 such that the loop 204 is formed proximate a lateral exterior edge of the pack 104. In FIG. 4B, the strap 302 is doubled back and fastened to itself with a fastening member 404 such as a snap. The fastening member 404 also attaches the strap 302 to the pack 104. In FIG. 4C, the strap 302 is also doubled back and fastening to itself with a fastening member 406 such as a snap. Here, however, the strap 302 is attached to the pack 104 with a means other than the fastening member 402, for example, by sewing the strap 302 to the pack 104.

FIG. 5 is a back view of the pack 104 attached to the vest 102. As shown, the loops 108 on the vest 102 can include a first subset of loops 502 and a second subset of loops 504. Similarly, the loops 110 on the pack 104 can include a first subset of loops 506 and a second subset of loops 508. The loops 502 of the vest 102 can be aligned in a generally linear arrangement. The loops 506 of the pack 104 can also be aligned in a generally linear arrangement. Moreover, the loops 506 of the pack 104 can be spaced apart from one another such that the loops 506 can be disposed between the loops 502 of the vest 102. In an example, the retaining member 106 can alternate between extending through a loop 502 and a loop 506. In an example, the loops 506 are formed of a strap having a width of approximately 1 inch which matches the approximately 1 inch space between the loops 502 of the vest 102.

The loops 504, 508 on the vest 102 and pack 104 respectively can be disposed in a similar manner. Accordingly, the loops 504 of the vest 102 can be aligned in a generally linear arrangement. The loops 508 of the pack 104 can also be aligned in a generally linear arrangement. Moreover, the loops 508 of the pack 104 can be spaced apart from one another such that the loops 508 can be disposed between the loops 504 of the vest 102. In an example, the retaining member 106 can alternate between extending through a loop 504 and a loop 508. In an example, the loops 508 are formed of a strap having a width of approximately 1 inch which matches the approximately 1 inch space between the loops 504 of the vest 102.

In an example, the general linear arrangement of loops 502, 506 is parallel to the generally linear arrangement of loops 504, 508. Particularly, in some examples, the loops 502, 504, 506, 508 are aligned in a generally vertical direction, however, in other examples, the loops 502 504, 506, 508 can be aligned in other directions such as horizontal.

The loops 502, 504, 506, 508 can also be attached to the vest 102 and pack 104 respectively in a manner that provides force to the pack 104 in opposite directions in order to hold the pack 104 in place with respect to the vest 102. For example, loops 502 and loops 506 with the retaining member 106 can combine to provide lateral (with respect to a user wearing the pack 104) in a first direction (e.g., to the left as shown in FIG. 5) and loops 504 and loops 508 with the retaining member 106 can combine to provide force in a lateral direction opposite the first direction. These opposing lateral forces can hold the pack 104 in place.

In an example, the retaining member 106 can include a rod, a cable, or the like that is configured to extend through at least one loop 108 on the vest 102 and at least one loop 110 on the pack 104. As shown in FIG. 5, the retaining member 106 can be configured to extend through the first generally linear arrangements of loops 502, 506 and the second generally linear arrangement of loops 504, 508. In some examples, the portions of the retaining member 106 (e.g., the rod and/or cable portions) can be generally linear in construction in order to allow removal from the generally linear arrangement of loops 502, 504, 506, 508 with a linear motion. Moreover, a diameter of the loops 108 (e.g., loops 502, 504) and 110 (e.g., loops 506, 508) and a diameter of the retaining member 106 along with a location of the loops 108, 110 can be selected such that the retaining member 106 remains in place during normal use of the vest 102 and pack 104, and can be removed with manual strength by pulling on the retaining member 106 in the appropriate (e.g., vertical) direction.

In an example, the portion of the retaining member 106 that extends through the loops can be a smooth, straight, and somewhat rigid material having a lubricity that enables the retaining member 106 to be pulled from the loops 108, 110 by a user using manual strength. In an example, this portion of the retaining member 106 can be composed of nylon 6,6, acetalcopolymer (Delrin®), 33 msi carbon vinyl ester, and/or nylon over top of carbon fiber. In other examples, other materials can be used such that the retaining member 106 provides sufficient strength (e.g., sheer strength) to maintain attachment of the pack 104 during normal use.

The retaining member 106 can also include a pull strap 510 that extends over a shoulder region of the vest 102. The pull strap 510 can be used to provide ready access to the retaining member 106 when the pack 104 is worn on a back of a user. In an example, the pull strap 510 can be attached by a fastening member to the shoulder region of the vest 102 in order to hold the pull strap 510 in position during use of the vest 102.

FIG. 6 is a close-up view of the vest 102 and pack 104 showing the retaining member 106. In an example, the retaining member 106 includes a portion formed from a single rod, where one end of the rod extends through the first generally linear arrangements of loops 502, 506 and the end of the rod extends through the second generally linear arrangement of loops 504, 508. The rod can be curved as shown to facilitate both ends extending through the two parallel arrangements of loops. In another example, a cable can be used in a similar manner. In an example, the pull strap 510 can be formed of a strap that is attached to the rod or cable portion with a fastening member such as a rivet and/or stitches.

As shown in FIG. 6, a lanyard 602 can be attached to the retaining member 106 and detachably coupled to the pack 104. In an example, the lanyard 602 can be attached to the retaining member 106 with a fastening device such as a rivet and/or stitches. The lanyard 602 can be detachably coupled to the pack 104 via a disable control 604 on the pack 104. In particular, the lanyard 602 can be detachably coupled to the disable control 604, such that detaching the lanyard 602 activates the disable control 604. Activating the disable control 604 can cause the disable control 604 to deactivate (e.g., zeroize, render unusable) electronics within the pack 104. In an example, the disable control 604 can erase, scramble, or render unusable memory in the pack 206. In some examples, the disable control 604 can destroy a key or other item necessary for operation of electronics within the pack 104.

The lanyard 602 can be configured to detach from the disable control 604 when the retaining member 106 is pulled from the loops 108, 110. This causes electronics with the pack 104 to be disabled when the pack 104 is detached from the pack 104 and possibly abandoned. In particular, with the lanyard 602 attached to a portion of the retaining member 106 above the pack 104, the lanyard 602 will be detached from the disable control 602 when the retaining member 106 is pulled (e.g., upward) to release the pack 104. Although a specific attachment location for the lanyard 602 to the retaining member 106 and the pack 104 is shown, it should be understood that other attachment locations can also be used.

In use, the pack 104 can be attached to the vest by inserting the retaining member 106 through the loops 502 and 504 of the vest 102. The pack 104 can then be aligned with the vest 104 and the straps 304 can be woven around the retaining member 106 and closed to form the loops 506, 508. In some examples, the pull strap 510 for the retaining member 106 can be attached (e.g., snapped) to the shoulder area of the vest 102 and the lanyard 602 can be coupled to the disable control 604 on the pack 104. In another example, the pack 104 (e.g., the loops 506, 608) can be aligned with the vest 102 (e.g., the loops 502, 504) and the retaining member 106 can be inserted through all the loops 502, 504, 506, 508.

For quick release of the pack 104, a user can detach (e.g., unsnap) the pull strap 510 from the vest 102 and pull the pull strap 510 in a forward, upward, and/or over the shoulder motion (when the pack 104 is mounted on the back of the user). Pulling the pull strap 510 causes the retaining member 106 to be pulled from the loops 502, 504, 506, 508, thereby releasing the pack 104 from the vest 102. In some examples, pulling the pull strap 510 also causes the lanyard 602 to detach from the disable control 604 thereby disabling electronics within the pack 104. The user is now free to move without the pack 104 attached thereto.

Although a single retaining member 106 has been shown, it should be understood, that multiple retaining members 106 may be used. For example, a first retaining member 106 can be inserted through loops 502 and loops 506 and a second retaining member 106 can be inserted through loops 504 and loops 508. To release the pack 104, the first and the second retaining members 106 could be individually pulled upward. In other examples, different configurations can be used. For example, individual rod or cable portions of a retaining member 106 can be inserted through loops 502 and loops 506 along with loops 504 and loops 508. These individual portions can then be attached together to a single pull strap 510 to form a retaining member 106 that can be pulled with a single strap.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. An apparatus for quick release of a pack from a vest of a user, the apparatus comprising:

a pack having one or more first loops; and a retaining member configured to extend through the one or more first loops and one or more second loops on the vest, wherein the retaining member is configured to releasably attach the pack to the vest by mechanically coupling the one or more first loops and the one or more second loops to the retaining member, wherein the retaining member is configured to enable detaching of the pack from the vest by pulling of the retaining member from the one or more first loops and the one or more second loops, wherein the retaining member includes a strap configured to extend over a shoulder area of the vest such that with the pack on a back area of the vest, the strap can be pulled upwards or over the shoulder area of the vest to remove the retaining member from the one or more first loops and the one or more second loops.

2. The apparatus of claim 1, wherein the retaining member includes a rod or a cable, and wherein the rod or cable is configured to extend through the one or more first loops and the one or more second loops.

3. The apparatus of claim 1, wherein the one or more first loops are aligned in a generally linearly arrangement and wherein the one or more second loops are aligned in a corresponding generally linearly arrangement such that the retaining member can be removed from the one or more first loops and the one or more second loops in a generally linear motion.

4. The apparatus of claim 1, wherein the one or more first loops include a first subset of loops generally aligned in a first line and matching with a corresponding first subset of the one or more second loops, and a second subset of loops generally aligned in a second line and matching with a corresponding second subset of the one or more second loops.

5. The apparatus of claim 4, wherein the first line and the second line are generally parallel.

6. The apparatus of claim 5, wherein the first line and the second line are configured to be generally vertical when the vest is worn by the user and the user is standing with the pack attached thereto.

7. The apparatus of claim 4, wherein the first subset and the second subset of the one or more first loops are disposed such that the first subset provides force to the pack in a direction opposite of the second subset.

8. The apparatus of claim 4, wherein the retaining member is configured such that the retaining member forms a curve wherein a first end of the retaining member extends through the first subset of the one or more first loops and a second end of the retaining member extends through the second subset of the one or more first loops.

9. The apparatus of claim 4, wherein the retaining member includes a first cable portion configured to extend through the first subset of the one or more first loops and a second cable portion configured to extend through the second subset of the one or more first loops, and wherein the first cable portion and the second cable portion are coupled together.

10. The apparatus of claim 1, comprising:

a lanyard attached to the retaining member and detachably coupled to a disable control on the pack such that forcing the retaining member and the pack in opposite directions causes the lanyard to detach from the disable control, wherein detaching the lanyard from the disable control causes the disable control to disable electronics associated with the pack.

11. The apparatus of claim 10, wherein the lanyard is detachably coupled to a top portion of the pack, and wherein the lanyard is configured to detach from the pack as the retaining member is pulled from the one or more first loops and the one or more second loops.

12. The apparatus of claim 1, wherein the one or more first loops are formed at least partially from a strap.

13. A method for quickly releasing a pack from a vest, the method comprising:

pulling a retaining member from one or more first loops of the pack and one or more second loops of the vest, wherein pulling causes the retaining member to move in a generally linear direction which causes the retaining member to be removed from the one or more first loops and the one or more second loops, wherein pulling the retaining member also causes a lanyard to detach from the pack thereby disabling electronics within the pack, wherein the retaining member once removed from the one or more first loop and the one or more second loops allows the pack to detach from the vest.

14. A system for quick release of a pack from a vest of a user, the system comprising:

a vest having a first plurality of loops on a back portion thereof;

a pack having a second plurality of loops configured to generally align with the first plurality of loops;

a retaining member configured to extend through the first plurality of loops and the second plurality of loops to releasably attach the pack to the vest by mechanically coupling the first plurality of loops and the second plurality of loops to the retaining member, wherein the retaining member is configured to enable detaching of the pack from the vest by pulling of the retaining member from the first plurality of loops and the second plurality of loops; and a lanyard attached to the retaining member and detachably coupled to a disable control on the pack, wherein pulling the retaining member causes the lanyard to detach from the disable control on the pack causing the disable control to disable electronics associated with the pack.

15. The system of claim 14, wherein the retaining member includes one of a rod and a cable, and wherein the one of a rod and a cable is configured to extend through the first plurality of loops and the second plurality of loops.

16. The system of claim 14, wherein the first plurality of loops includes a first subset of loops generally aligned with a corresponding first subset of the second plurality of loops, and wherein the first plurality of loops includes a second subset of loops generally aligned with a corresponding second subset of the second plurality of loops, wherein the first subset of loops and the second subset of loops form lines that are generally parallel to each other.

17. The system of claim 16, wherein the retaining member includes a rod configured with a curve wherein a first end of the rod extends through the first subset of the first plurality of loops and a second end of the rod extends through the second subset of the first plurality of loops.

18. The system of claim 16, wherein the retaining member includes a first cable portion configured to extend through the first subset of the first plurality of loops and a second cable portion configured to extend through the second subset of the first plurality of loops, and wherein the first cable portion and the second cable portion are coupled together.

19. The system of claim 14, wherein the second plurality of loops are formed at least partially from a strap.

* * * * *